United States Patent [19]

Preus

[11] 4,227,478

[45] Oct. 14, 1980

[54] INFLATABLE BARGE WITH COMPARTMENTED INTERIOR

[76] Inventor: Paul Preus, 21 Smith Rd., Toms River, N.J. 08753

[21] Appl. No.: 950,279

[22] Filed: Oct. 11, 1978

[51] Int. Cl.[2] ..... B65D 89/10

[52] U.S. Cl. ..... 114/256

[58] Field of Search ..... 114/74 R, 74 T, 219, 114/220, 256, 257, 270; 405/26, 60, 63, 64, 68, 72; 220/22

[56] References Cited

U.S. PATENT DOCUMENTS

| | | | |
|---|---|---|---|
| 2,346,505 | 4/1944 | Preus | 114/74 R |
| 3,067,712 | 12/1962 | Doerpinghaus | 114/74 T |
| 3,435,793 | 4/1969 | Shurtleff | 114/257 |
| 3,849,989 | 11/1974 | Preus | 405/26 |

*Primary Examiner*—Edward R. Kazenske
*Assistant Examiner*—Jesús D. Sotelo
*Attorney, Agent, or Firm*—Harold L. Stowell

[57] ABSTRACT

An air or surface deployable inflatable, flexible wall, fluid holding barge is provided with a plurality of internal compartments and is provided about at least a portion of its outer skin with a gas inflatable barrier which improves the floatability of the barge and materially reduces the danger of skin rupture during the filling, towing and off-loading operations.

6 Claims, 8 Drawing Figures

INFLATABLE BARGE WITH COMPARTMENTED INTERIOR

CROSS-REFERENCE TO RELATED APPLICATION

Related subject matter is disclosed and claimed in my co-pending application Ser. No. 938,426, filed Aug. 31, 1978.

BACKGROUND OF THE INVENTION

1. Field of the Invention

This invention is directed to an air or surface deployable, inflatable, flexible, towable container for liquids which is protected against skin rupture on wrecks, rocks, jetties, or during beaching or by collision and is proveded with a plurality of internal compartments.

2. Description of the Prior Art

It has been known for a number of years that there is a substantial need to expedite oil pollution control operations including deploying at the scene of a casualty or potential casualty barge means whereby oil and other liquids can be off-loaded from tankers, tank ships, barges, or vessels as is necessary to refloat them and or to prevent or minimize water pollution by the vessel contained fluids if the vessel suffers hull damage due to heavy seas or becomes grounded.

The above recited needs have been in part satisfied by the use of a few rubberized holding tanks having capacities from about five to over one thousand cubic meters which floatable, rubberized holding tanks, once filled with the off-loaded liquids, are towed to discharged facilities which may be other vessels, or at dockside.

However, current models of such inflatable, flexible holding tanks lacked safety features to prevent further pollution often caused by rips or tears in the fabric skin adding to the pollution which the holding tank was intended to diminish or abate.

SUMMARY OF THE INVENTION

The invention may be summarized as an air or surface deployable, inflatable, flexible wall, fluid holding, towable container comprising a hollow, generally tubular, flexible wall container, a plurality of internal compartments in said container, at least one closeable inlet and outlet means for each of the compartments for directing fluids into and out of the container compartments further characterized by gas inflatable barrier means extending at least along the longitudinal side walls of said container in the zone of the water line of the container when it is filled with a liquid.

BRIEF DESCRIPTION OF THE DRAWING

The invention will be more particularly described in reference to the drawing wherein.

DESCRIPTION OF THE PREFERRED EMBODIMENTS

Figure 1:
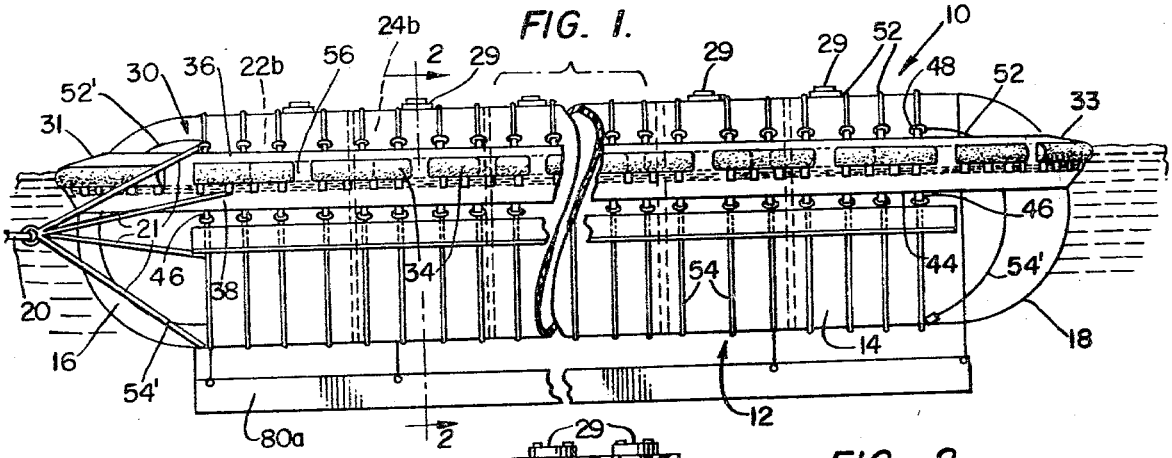
FIG. 1 is a fragmentary elevational view of a flexible wall container of the invention having one means of protecting the side walls thereof.
Figure 2:
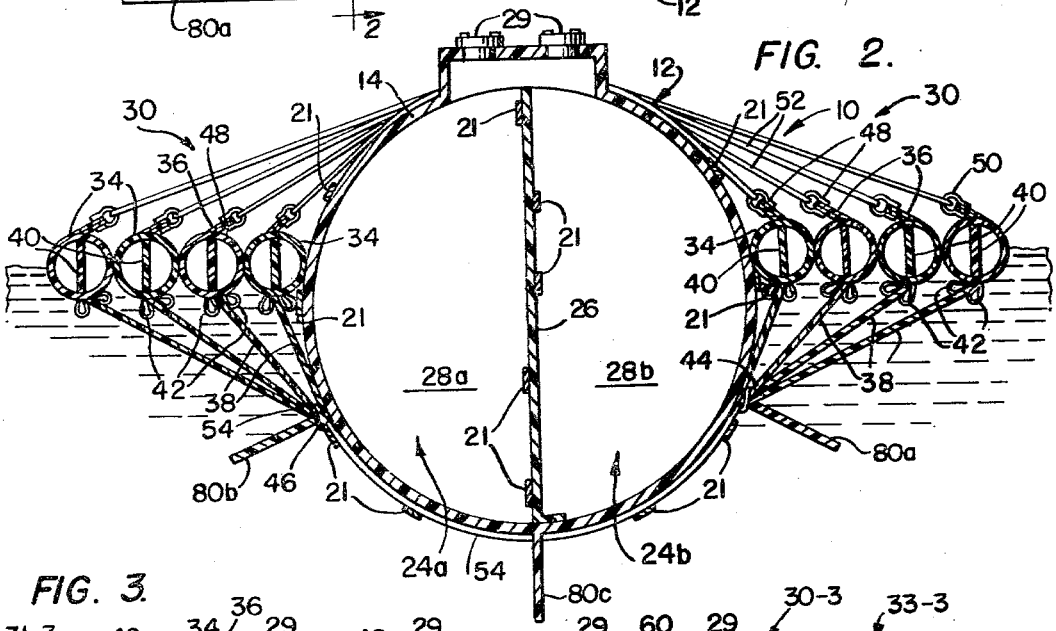
FIG. 2 is a section on line 2—2 of FIG. 1.

Referring to FIGS. 1 and 2, 10 generally designates one embodiment of applicant's improved inflatable barge or container. The assembly 10 includes an elongated tubular, flexible wall, towable container 12 having cylindrical side wall 14, and end walls 16 and 18. The forward end wall 16 is provided with a towing cable 20.

The towing cable 20 connects to a plurality of straps 21 stitched or otherwise adhered to the outer surface of the side wall 14 and to opposite surfaces of longitudinal partition 26 as more clearly shown in FIG. 2.

Internally, the container 12 is divided into a plurality of compartments which are in fluid isolation. The compartments are designated 22*a-b*, 24*a-b*, etc., and are formed by a longitudinal partition 26 and transverse partition 28*a* and 28*b*.

Each compartment 22*a*, 22*b*, 24*a*, 24*b*, etc., is provided with closeable ports 29 for directing fluids into and out of the plural compartments 22*a*, *b*, 24*a*, *b*, etc.

The container 10 has its outer skin made from, for example, synthetic rubber-coated nylon fabric and cord and preferably the interior is provided with a nitrile coating that is unaffected by petroleum products and the outside is, for example, neoprene which withstands abrasion, sunlight, salt water and ozone attack.

The partitions 26, 28*a* and 28*b* are made from, for example, synthetic rubber-coated nylon fabric and cord coated on both surfaces with a nitrile coating that is unaffected by petroleum products.

Notwithstanding the employment of rubber fabric, cord and plastic composites for the skin, damage to the skin can occur and a single tear in the skin permits the release of the contents of the affected compartment into the water and such tears can be brought about by rocks, jetties, river beds, collision, beaching, and where the container is used to off-load oil and other contaminating fluids from wrecks, which often occurred during the inclement weather, the risk of tearing the skin is increased many fold.

Such containers can be made in lengths of, for example 10 to 100 meters and diameters of 1 to over 5 meters; thus, having capacities in the order of 50 to over 1,000 cubic meters.

In order to reduce the hazards involved in using such inflatable, flexible wall, fluid holding, towable containers, the skin is protected by gas inflatable barrier means generally designated 30, 31 and 33.

In the form of the invention shown in FIGS. 1 and 2, the inflatable protective barriers consist of a flexible fabric impregnated with vulcanized rubber or plastic composition preferably inert to hydrocarbons which fabric is formed to provide a plurality of spaced flotation cells 34, longitudinal top rib 36, and skirt portion 38.

Preferably, each flotation cell 34 has a longitudinal central division strip constructed of the same fabric material so that with the rib or strip 40 in sealing engagement with the walls of the flotation cells 34, there is in effect two cells to each unit 34. Strength is provided by forming the fabric just below the flotation cells 34 with a pair of pockets or pouches 42 containing cables or chains or the like.

Along the lower longitudinal edge 44 of the skirt 38 are provided a plurality of anchoring loops 46 and similar anchoring loops 48 are provided along the top ridge member 36. Shackle elements 50 are mounted to the loops 46 and 48 through which cables 52 at the top and 54 at the bottom are attached. The cables 52 and 54 cross over and under the container 12 and are attached to corresponding inflatable barriers on the opposite side of the container as more clearly illustrated in FIG. 2.

Inflatable protective barriers 31 and 33 for the front and rear ends 16 and 18 of the container 12 are formed like the protective barriers 30 hereinbefore described and are likewise held in place by cables 52' and 54' which, as illustrated, may be attached to cables 52 and 54 of protective barriers 30.

In the preferred embodiment illustrated in FIGS. 1 and 2, at least two side-by-side flotation barrier means are provided for each tank; thus, at the water line there are six layers of rubberized or plasticized fabric plus the resilient bumper control of the air flotation chambers themselves which must be penetrated prior to reaching the skin 14 of the flotation tank. When a pair of side-by-side barrier means are provided for the tank having spaced flotation cells 34, the units are positioned such that a flotation cell of one of the units is positioned to overlap the gap 56, FIG. 1, between flotation cells of the adjacent barrier. From the foregoing, it will be seen that the combination of a multiple celled, flexible wall container provided with wall protecting means materially improves the reliability of such barges.

One form of commercial inflatable barrier means which has proved to be very satisfactory for use as a protective means of the present invention are disclosed in my U.S. Pat. No. 3,849,989, issued Nov. 26, 1974. Flotation barriers of the type illustrated in my said prior patent are readily available and many thousands of feet are held in reserve by the Navy, Coast Guard, and oil spill, clean-up cooperatives. With some 20,000 feet in special commercial cargo containers for each worldwide deployment.

It will be noted from FIG. 2 that the units 30 also provide means for preventing the container from rolling and act as outriggers for the container, thus in part, eliminating the need for keel in this form of the invention, however, such keels are shown at 80*a, b,* and *c,* and are formed as an integral part of the skin of the barge.

It will be recognized by those skilled in the art that where desired, another row or rows of inflatable barriers may be added below or outboard of the units 30 if the seas are particularly rough and greater bouyancy is desired.

Figure 3:
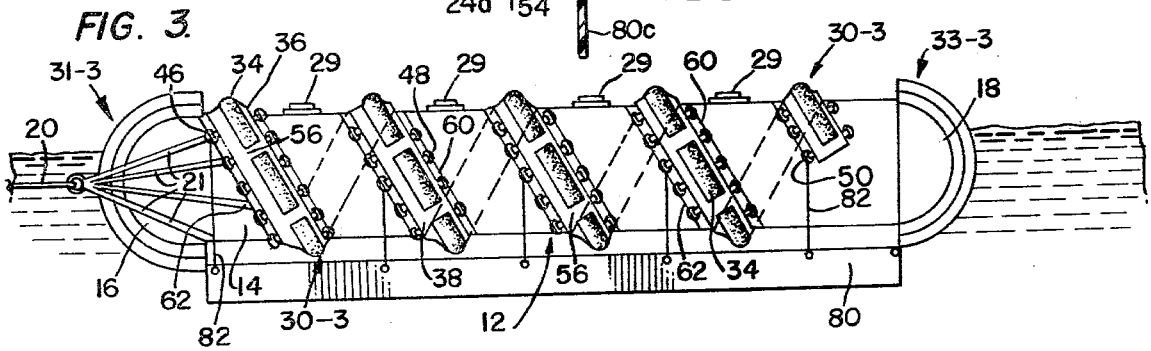
FIG. 3 is a view like FIG. 1 of a modified form of the present invention.

Referring now to the form of the invention illustrated in FIG. 3, there is shown a flexible wall, plural compartment container 12, which may be identical to that illustrated in FIGS. 1 and 2, and includes an outer cylindrical skin 14, a front end 16, a rear end 18, plural filler ports 29, and a tow cable assembly 20. About the external surface of the skin 14 of the container 12, is spirally wrapped one or more inflatable barriers 30-3, and end barriers 31-3, and 33-3.

The inflatable barriers 30-3 may be identical to the inflatable barriers 30 illustrated in FIGS. 1 and 2 and would include the inflatable chamber areas 34, a skirt portion 38, a wing portion 36, and connector tabs 46 along the lower margin of the skirt 38 and connector tabs 48 about the upper edge of the wing portion 36. Cables or chains 60 are connected to the plural connectors 48 along the wing portion 38 to retain the flotation element 30 in its spiral configuration about the outer skin 14 of the tank 12. A similar chain or cable 62 is connected to the connectors 46 along the lower edge of the skirt portion 38 and assist in attaching the flotation means 30-3 in its spiral configuration to the tank 12.

In FIG. 3, a single layer of the flotation means 30-3 is illustrated as being spirally positioned about the longitudinal axis of the tank 12; however, as depicted in FIG. 2, two layers of the cells 30-3 may be employed so that the flotation cells 34 overlap the open spaces 56 between opposed layers to thereby insure that there are plural layers of fabric which must be penetrated prior to penetration of the skin 14 of one of the compartments of the tank 12.

It will be noted that the end barriers 31-3 and 33-3 are not merely continuations of the spirally wrapped units 30-3, but independent units secured in a somewhat vertical array. The cables attaching units 31-3 and 33-3 to the container may be attached to the cables from unit 30-3 so that the three units are all tied or connected to each other.

Unlike the form of the invention shown in FIGS. 1 and 2, the protective barrier units 30-3, 31-3 and 33-3 do not function as outriggers; it is necessary in order to stabilize the container from rolling that one or more keels 80 be hung from the lower cable 62, and/or 60 or the shackle elements 50., by cables or chains 82. The keels 80 may take various forms, including the "sea anchor" form of the sea anchor pockets in the skirt of my U.S. Pat. No. 3,795,315, granted Mar. 5, 1974.

Figure 4:
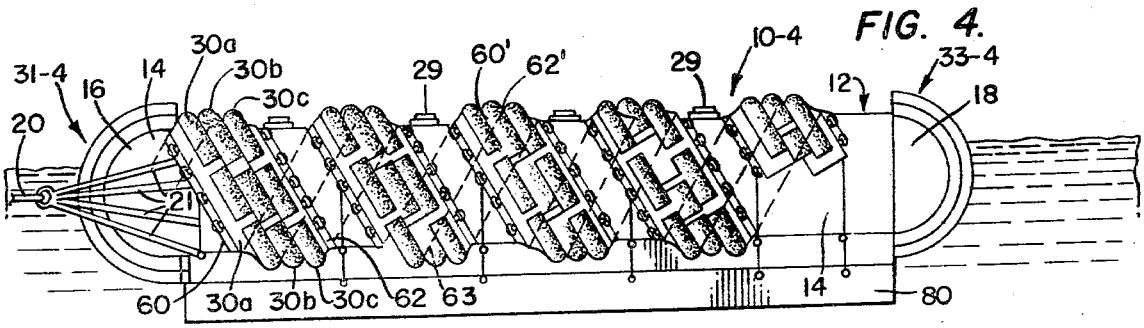
FIG. 4 is a view like FIG. 1 of another form of the present invention.

Referring now to FIG. 4 of the drawing, a preferred form of the spirally-configured, inflatable protector is illustrated and designated 10-4. In this form of the invention the container 12 may be identical to that illustrated in FIGS. 1 through 3 and includes a skin portion 14 front and rear ends 16 and 18, a towing cable or bridle assembly 20 and a plurality of filler ports 29 for filling and emptying the container 12.

About the outer surface of the container 12 are spirally wrapped three flotation and protection barriers designated 30*a,* 30*b,* and 30*c.* In this form of the invention, the spirally-wound flotation means 30*a, b,* and *c* are identical to that illustrated in FIG. 3 and in spirally wrapping the three units; units 30*a* and 30*c* are first wrapped in the illustrated spiral configuration and secured thereto by their respective cables 60, 62, and 63 with cable 63 being common to the lower skirt portion of flotation means 30*c* and the wing portion of unit 30*a.* After the flotation means 30*a* and 30*c* are spirally wrapped and secured by cables 60, 62, and 63; the third element 30*b* is spirally wrapped as illustrated to provide in the zones of the spiral configuration at least six protective layers which must be penetrated prior to penetration of the skin 14 of the tank 12.

The top layer of spirally wound, inflatable protecting means 30*b* is also provided with cables 60' and 62' at the upper and lower edges thereof which cables like 60, 62, and 63 secure the flotation means 30*b* in its desired location.

As in the other forms of my invention, the front end 16 and the rear end 18 of the container are protected by flotation barriers 31-4 and 33-4 and one or more keels 80 are suspended from the cables attaching units 30*a, b* and *c* to the container.

Figure 5:
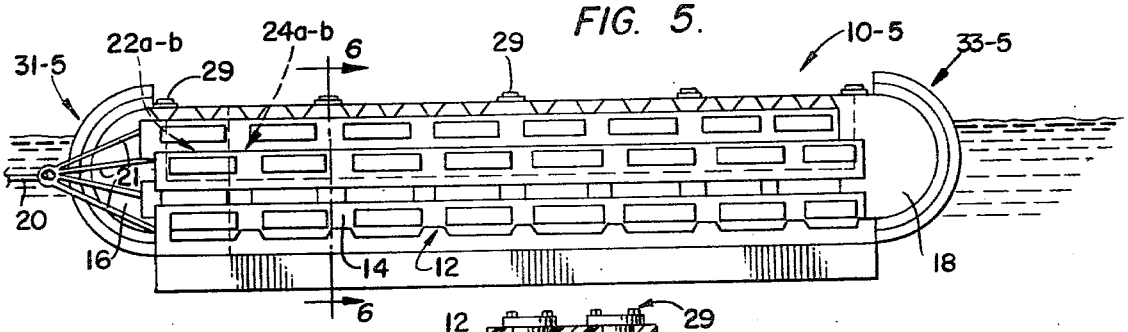
FIG. 5 is a view like FIG. 1 of a further form of the present invention.
Figure 6:
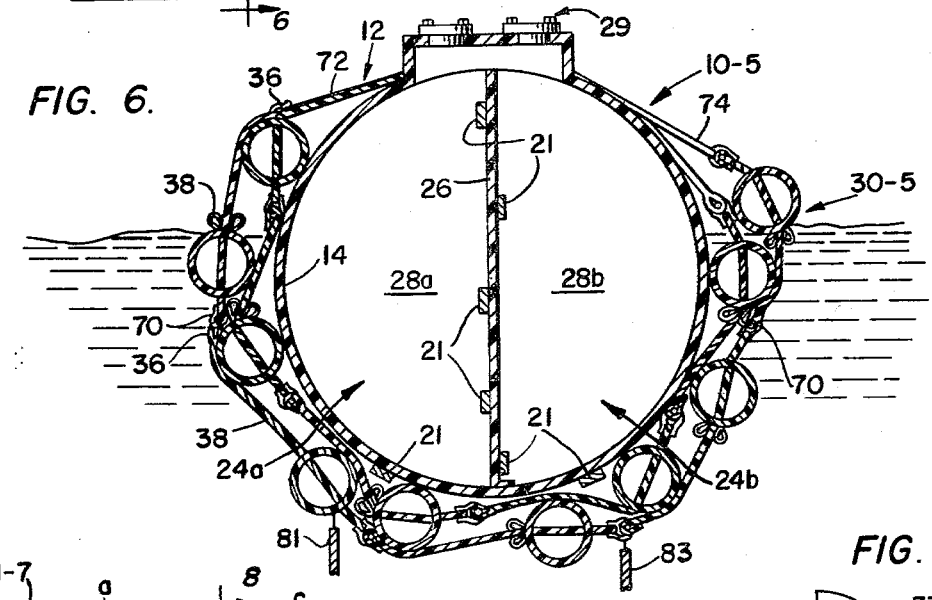
FIG. 6 is a section on line 6—6 of FIG. 5.

It will be particularly noted that in spirally wrapping the flotation means in the FIGS. 3 and 4 form of the invention the wrapping is such as to leave exposed the filling port 29 and in so doing portions of the side wall 14 of such containers are left somewhat exposed which is not the case with the assembly shown in FIGS. 5 and 6.

Referring now to FIGS. 5 and 6, a particularly advantageous configuration of plural inflatable protection units for the inflatable, flexible, plural chambered and towable container is illustrated. In FIG. 5, the unit is generally designated 10-5 and includes the container 12 which may be identical to the containers 12 illustrated in FIGS. 1 through 4. The container 12 has an outer cylindrical skin 14 and front and rear end walls 16 and 18, and is protected by a plurality of horizontally extending protective barriers 30-5 arranged in a plurality of over-lapping rows as more clearly illustrated in FIG. 6.

Internally, the container 12 is divided into a plurality of compartments which are in fluid isolation. The compartments are designated 22*a-b*, 24*a-b*, etc., and are formed by a longitudinal partition 26 and transverse partitions 28*a* and 28*b*.

Each compartment 22*a*, 22*b*, 24*a*, 24*b*, etc., is provided with closeable ports 29 for directing fluids into and out of the plural compartments 22*a*, *b*, and 24*a*, *b*, etc.

The over-lapping rows of protective barriers 30-5 are arranged such that all areas of the container 12 in an arc of at least about 240 degrees is intimately protected by the inflatable protective barriers 30-5, which 240 degrees includes at least the complete zone of submergence of the tank 12 when filled with a liquid. In FIG. 6, it will be noted that the plural protective inflatable barrier means 30-5 are chained with the wing portion 38 of another by suitable connectors such as illustrated at 70 and relatively short cables 72 and 74 lash the units over the top of the container 12. In assembling this form of the invention, the connectors 70 of a plurality of rows of protective barriers 30-5 are first assembled and the assembled units are then positioned about the container 12 and maintained thereon by the cable 72 and 74.

As in the other forms of my invention, the front end 16 and the rear end 18 of the container 10-5 are protected by flotation barriers 31-5 and 33-5.

Further, in this form of the invention a pair of keels 81 and 83 are suspended from the protective barrier 30-5 and such keels may be of the sea anchor type. It will also be recognized by those skilled in the art that only a center keel or a center and two-side keels may be used without departing rrom the scope of the present invention.

Figure 7:
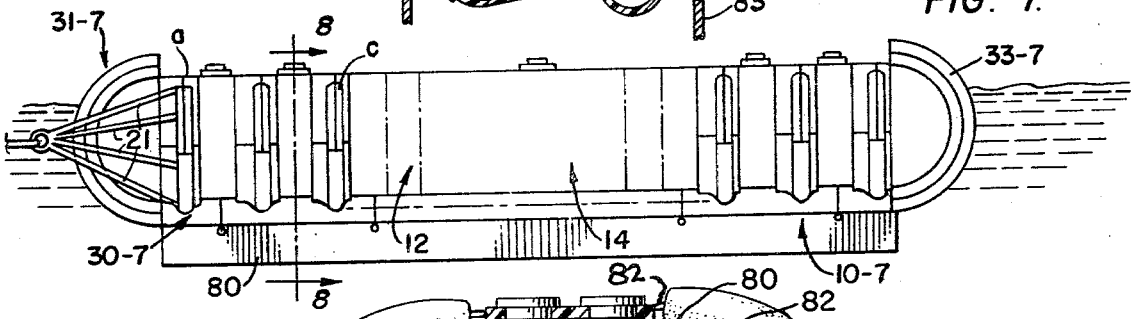
FIG. 7 is a view like FIG. 1 of still another form of the present invention.
Figure 8:
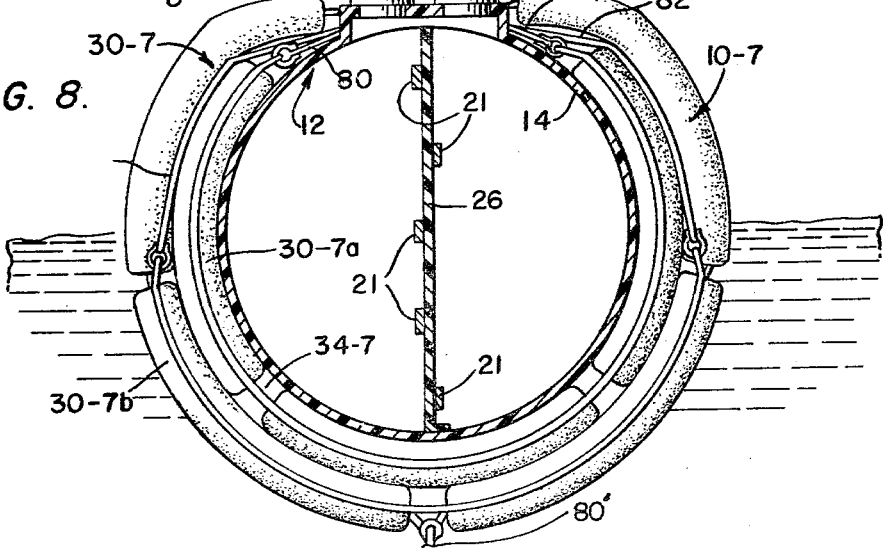
FIG. 8 is a section on line 8—8 of FIG. 7.

Referring now to FIGS. 7 and 8 of the drawing, a further embodiment of the present invention is illustrated wherein the protective inflatable barriers are mounted in a plurality of discrete rings. In FIGS. 7 and 8, the inflatable barge is generally designated 10-7, and includes the deployable, inflatable, flexible, towable container 12 which may be identical to those illustrated in the previous forms of the invention which container includes an outer skin 14. About the outer skin 14 are a plurality of rings a, b, c, etc. of inflatable protective barriers 30-7. In FIG. 8 it will be seen that each ring a, b, c, etc., is composed of two concentric layers of the barriers 30-7 which may be of identical construction to the inflatable barriers 30 of FIGS. 1 and 2 of the invention.

In assembling this form of the invention, the first layer designated 30-7*a* is wrapped about the outer surface 14 of the container 12 and secured thereto by cables 80 and then the second layer designated 30-7*b* is laid about the first layer 30-7*a* in a staggered configuration such that open spaces between the flotation elements 34-7 are covered by the outer layer 30-7*b*. Then, the outer layer 30-7*b* is secured in its desired configuration by cables 82. This process is repeated for each of the rows a, b c, etc., and the rows may be as close as desired depending on the nature of the intended use of the inflatable barge.

As in the other forms of my invention, the front end 16 and the rear end 18 of the container are protected by flotation barriers 31-7 and 33-7 and one or more keels 80′ are suspended from cables attaching units 30-7 to the container.

From the foregoing, it will be seen that the present invention provides a very simple, but highly effective means for rendering prior art conventional and highly vulnerable inflatable containers susceptible of meeting present day standards of safety.

It will also be recognized by those skilled in the art that various other configurations may be employed without departing from the scope of the present invention.

I claim:

1. An air or surface deployable, inflatable, flexible wall, fluid holding towable container comprising a hollow, generally tubular, flexible wall container, a vertically oriented partition extending the length of the container, a plurality of partitions positioned in spaced relation to one another extending transversely to the lengthwise extending partition, said length-wise extending and transverse partitions dividing the container into a plurality of compartments, closeable fluid filling-emptying ports in the top wall of the container, gas inflatable barrier means extending at least along a substantial portion of the longitudinal side walls of said container in the zone of the water line of the container when it is filled with a liquid;

said gas inflatable barrier means comprising a plurality of independently gas inflatable chambers arranged in a spaced array and connected together by impervious impregnated fabric, whereby rupturing of one of the plurality of independently inflatable chambers will not impair the function of the other of the chambers.

2. The invention defined in claim 1 wherein the gas inflatable barrier means comprises a pair of opposed horizontally and longitudinally extending inflatable barriers at each side of the flexible wall container and cable means extending from each of the inflatable barrier means about the remainder of the generally cylindrical surface of the container.

3. The invention defined in claim 1 wherein the inflatable barrier means is spirally wound about the external longitudinal surface of the flexible wall container.

4. The invention defined in claim 3 wherein the spirally wound inflatable barrier means comprises a plurality of layers of such spiral windings.

5. The invention defined in claim 1 wherein the inflatable barrier means comprises a plurality of superimposed longitudinally extending barriers covering at least about 240 degrees of the external surface of the flexible wall container.

6. The invention defined in claim 1 wherein the inflatable barrier means comprises a plurality of generally ring-shaped layers of barriers arranged in spaced longitudinal arrangement about the flexible wall container.

* * * * *